US005438773A

United States Patent [19]

Chaffee

[11] Patent Number: 5,438,773

[45] Date of Patent: Aug. 8, 1995

[54] FIBER DECLUMPER

[76] Inventor: Rebecca J. Chaffee, P.O. Box 333-1000 Bullock La., Elk City, Id. 83525

[21] Appl. No.: 292,216

[22] Filed: Aug. 19, 1994

[51] Int. Cl.[6] ..... F26B 19/00

[52] U.S. Cl. ..... 34/61; 34/597; 34/390; 34/60; 206/0.5

[58] Field of Search ..... 34/60, 389, 390, 597, 34/599, 61; 206/0.5, 0.7, 524.6

[56] References Cited

U.S. PATENT DOCUMENTS

| | | | |
|---|---|---|---|
| 3,633,538 | 10/1970 | Hoeflin | 34/60 |
| 4,532,719 | 8/1985 | Davies et al. | 34/389 |
| 4,532,722 | 8/1985 | Sax | 34/60 |
| 4,567,675 | 2/1986 | Rennie | 34/60 |

*Primary Examiner*—Denise L. Gromada
*Assistant Examiner*—Susanne C. Tinker

[57] ABSTRACT

To attain this, the present invention essentially relates to a fiber declumper device for use in conjunction with a fiber-filled construction such as a down-filled sleeping bag during treatment of such construction in a rotary drum dryer which comprises a solid foot-shaped structure formed of dense heat-resistant plastic, rubber or the like. This device is placed in the dryer along with the fiber-filled construction to be dried and, as the dryer drum rotates, the device preferably in the shape of a foot, beats on the fiber-filled construction preventing clumping of the fiber contained therein. A cavity within the beating member device contains heat-activated scent material which will impart a pleasant odor to the construction being heated.

3 Claims, 4 Drawing Sheets

FIBER DECLUMPER

BACKGROUND OF THE INVENTION

1. Field of the Invention

The present invention relates to a device for use in a drum dryer and more particularly pertains to such a device which may be used to minimized fiber clumping in a construction such as a sleeping bag while it is being dried in a drum dryer.

2. Description of the Prior Art

The use of scent-dispensing devices in clothes dryers is known in the prior art. More specifically, such devices heretofore devised and utilized for the purpose of dispensing scents are known to consist basically of soft flexible sachet type pockets designed to slide easily within and through a load of clothes being dried in the dryer and to dispense granules, powder or the like into the load. Typical of such devices are shown in U.S. Pat. Nos. 4,567,675; 3,948,387; 4,532,719; 5,147,715; and 4,114,284.

In this respect, the device according to the present invention substantially departs from the conventional concepts and designs of the prior art, and in so doing provides an apparatus primarily developed for the purpose of physically beating the material being dried within a drum dryer while the dryer rotates and incidentally dispensing an aroma which will permeate the material being dried. The device must be of substantial rigidity and size as contrasted to the sachet type devices of the prior art. The standard method of drying a down sleeping bag is to toss an old sneaker in with the bag. Disintegration of the sneaker during such use imparts particles of rubber, canvas or the like which gets into the bag and sharp edges, as on the grommet eyes and holes of the conventional sneaker may damage or tear the bag. The present device replaces the sneaker and eliminates the disadvantages thereof.

Therefore, it can be appreciated that there exists a continuing need for new and improved devices which can be used to declump fiber-filled construction such as sleeping bags while they are being dried. In this regard, the present invention substantially fulfills this need.

SUMMARY OF THE INVENTION

In view of the foregoing disadvantages inherent in the known types of devices now present in the prior art, the present invention provides an improved construction wherein the same can be utilized it safely and easily declump the fill of a fiber-filled construction such as a down sleeping bag during drum drying. As such, the general purpose of the present invention, which will be described subsequently in greater detail, is to provide a new and improved fiber declumping or fluffing apparatus which has all the advantages of the prior art devices and none of the disadvantages.

To attain this, the present invention essentially relates to a fiber declumper device for use in conjunction with a fiber-filled construction such as a down-filled sleeping bag during treatment of such construction in a rotary drum dryer which comprises a solid foot-shaped structure formed of dense heat-resistant plastic, rubber or the like. This device is placed in the dryer along with the fiber-filled construction to be dried and, as the dryer drum rotates, the device preferably in the shape of a foot, beats on the fiber-filled construction preventing clumping of the fiber contained therein. A cavity within the beating member device contains heat-activated scent material which will impart a pleasant odor to the construction being heated.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved fiber declumping device which has all the advantages of the prior art devices and none of the disadvantages.

It is another object of the present invention to provide a new and improved fiber declumping device which may be easily and efficiently manufactured and marketed.

It is a further object of the present invention to provide a new and improved fiber declumping device which is of a durable and reliable construction.

An even further object of the present invention is to provide a new and improved fiber declumping device which is susceptible of a low cost of manufacture with regard to both materials and labor, and which accordingly is then susceptible of low prices of sale to the consuming public, thereby making such devices economically available to the buying public.

Still yet another object of the present invention is to provide a new and improved fiber declumping and scenting device which provides in the apparatuses of the prior art some of the advantages thereof, while simultaneously overcoming some of the disadvantages normally associated therewith.

Still another object of the present invention is to provide a new and improved device for use in a drum dryer along with a fiber-filled fabric construction.

Yet another object of the present invention is to provide a new and improved device for preventing clumping of fibers within a sleeping bag or the like during the drying thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
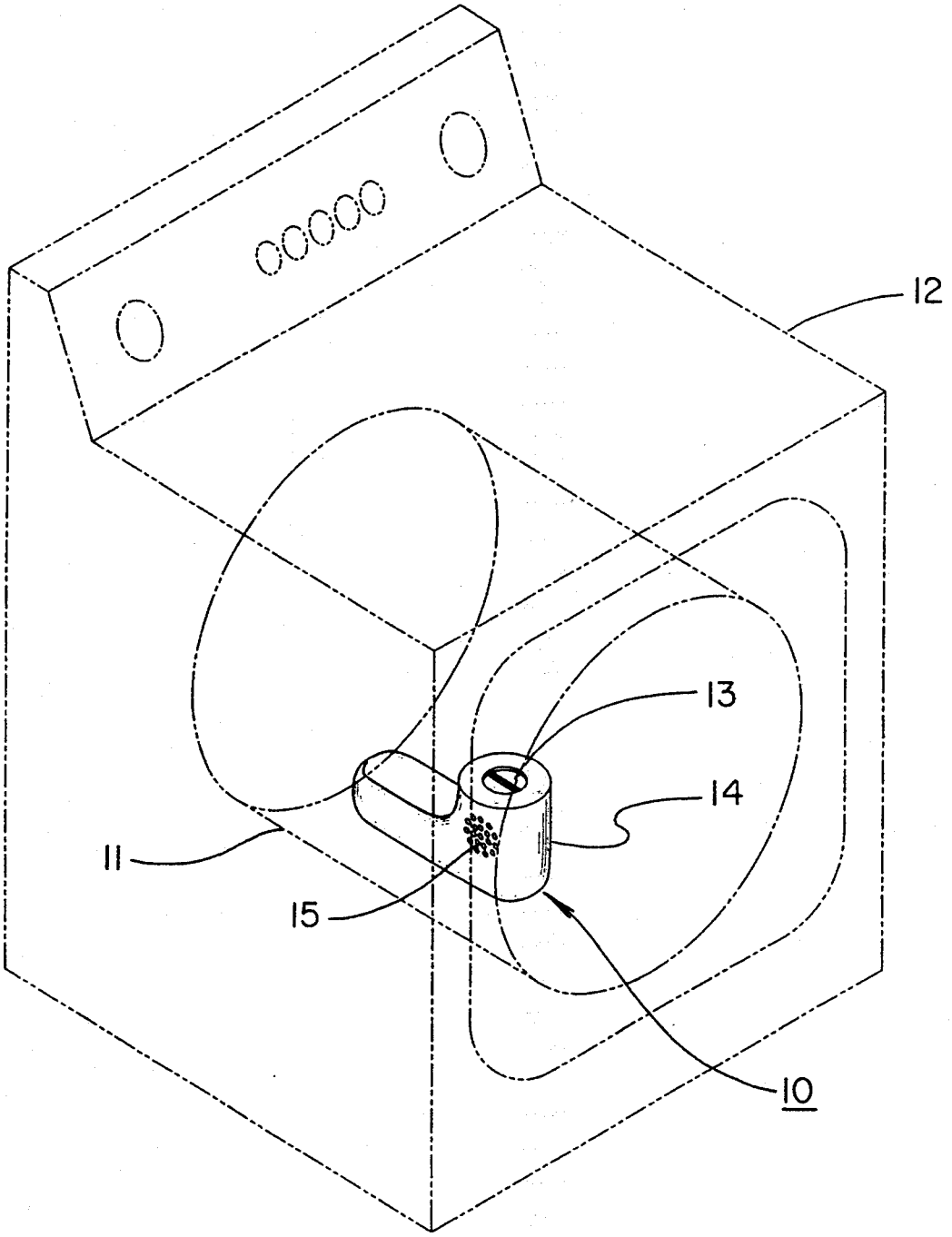
FIG. 1 is a perspective view of the device of the present invention in operative position within a drum dryer.

With reference now to the drawings, and in particular to FIG. 1 thereof, a new and improved Fiber declumping device embodying the principles and concepts of the present invention and generally designated by the reference numeral 10 will be described.

More specifically, it will be noted that the preferred shape of the device 10 of the present invention resembles a human foot and ankle or a boot designed to fit thereover. FIG. 1 illustrates the device 10 in its operative position enclosed in the drum 11 of a conventional rotary drum dryer 12 (shown in broken lines). The foot-shaped device 10 has an inset perforated canister 13 conveniently located in the upstanding ankle portion 14 of boot 10. A plurality of perforations 15 extend from the exterior of ankle portion 14 to the canister 13 as shown in detail in FIG. 4 below. The remainder of device 10 is formed of a dense, heat-resistant polymer material or of rubber or the like. Device 10 accordingly has substantial mass and weight, serving to beat upon any clothing or other fiber-filled item enclosed in the dryer drum 11 along with the device 10.

Figure 2:
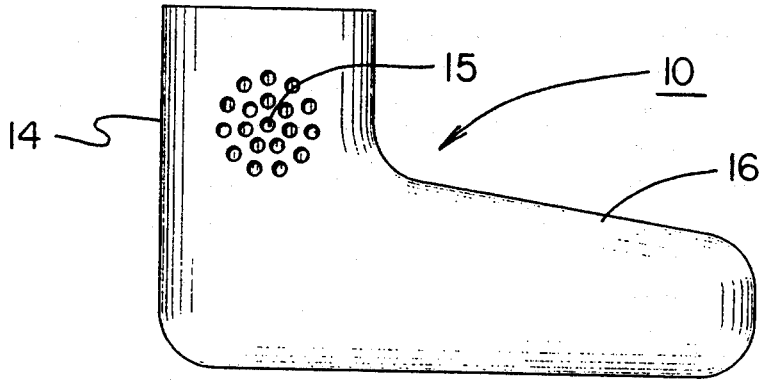
FIG. 2 is a side plan view of the device of the present invention.

FIG. 2 is a side plan view of the device 10 showing the foot portion 16 of boot 10 and the ankle portion 14 thereof. Perforations 15 extending into the ankle portion 14 are also shown.

Figure 3:
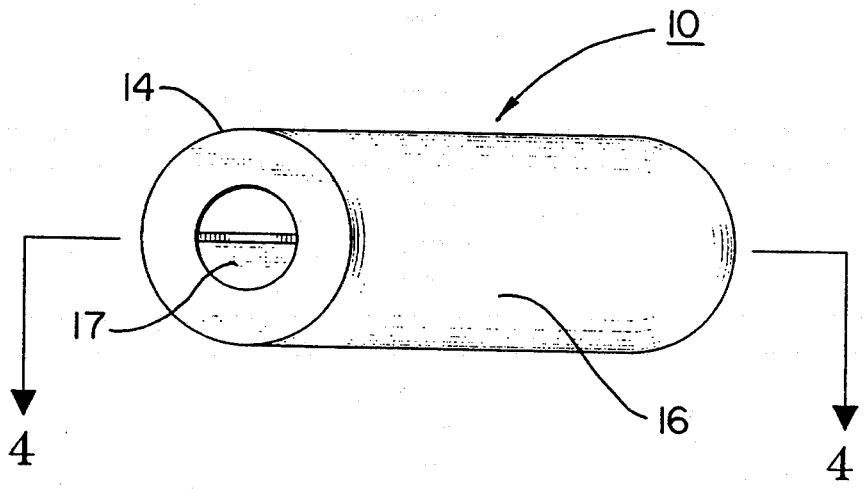
FIG. 3 is a top plan view of the device of the present invention.

FIG. 3 is a top plan view of device 10 illustrating the top closure 17 of canister 13 inserted in the ankle portion 14 of boot 10.

Figure 4:
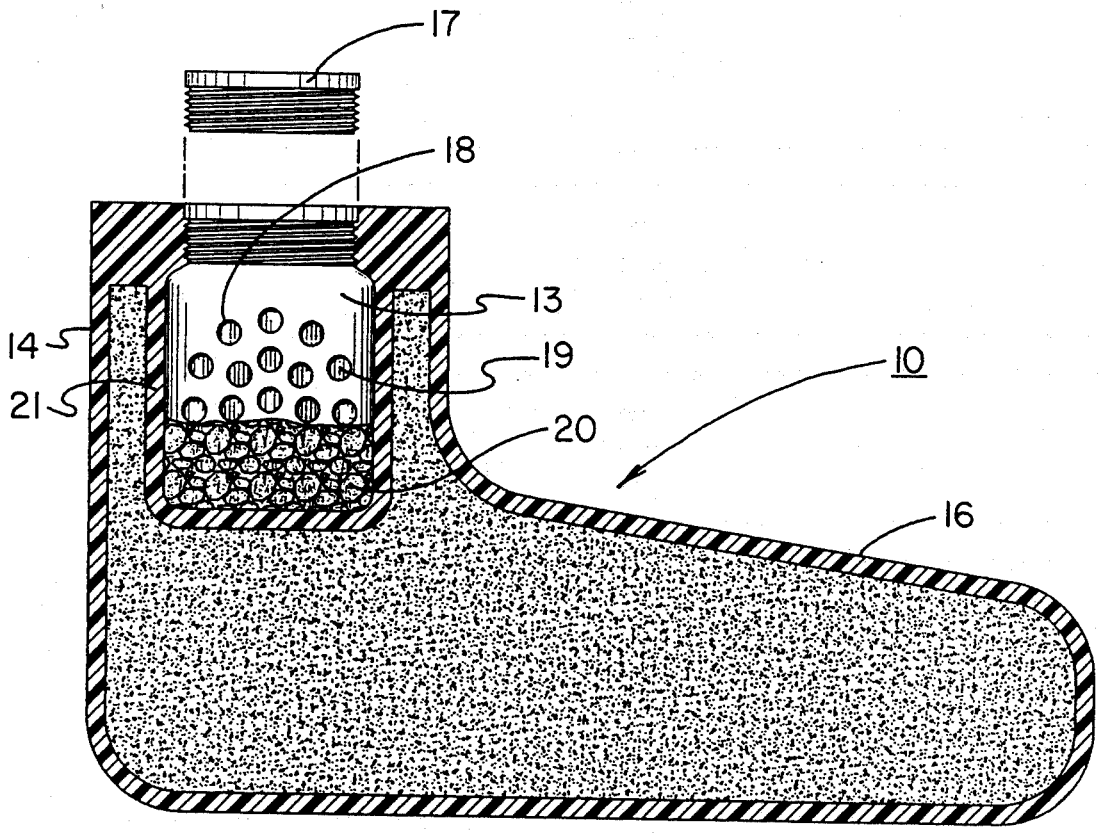
FIG. 4 is a partially exploded side sectional view of the device of FIGS. 2 and 3 taken on line 4—4 of FIG. 3.

FIG. 4 illustrates device 10 in detail showing in partial section the canister 13 with a screw closure top 17 exploded for clarity. Canister 13 also has perforations 18 similar to those extending through the ankle 14 of boot 10 shown in FIG. 2 and comminuting therewith. Such perforations 18 are covered with a mesh of a heat-resistant plastic fiber. The function of mesh 19 is to prevent the escape of particulate odor-dispensing material (like that shown as pellets 20 within the canister 13) from such canister into and though perforations 15 in the boat 10 and thence into the drum 11 of dryer 13 as the device 10 rotates therein. Mesh 19 will however, permit the escape of pleasantly scented aromatic vapors from such pellets 20 as the material of pellets 20 is activated by the heat in such drum 11 as dryer 12. Such scents, typically pine or the like, may come from any of the many commercially available pellets used in room conditioners or the like, all of which are activated by heat. Canister 13 is further sealed against loss of particulate material by a screw lid or top 17 which also serves to permit replenishment of pellets as needed. Canister 13 is inserted into a receptacle 21 fixedly positioned in ankle portion 14 normally as a permanent fixture in boot 10, although ankle 14 may be designed to permit removal of canister 13 if desired.

Figure 5:
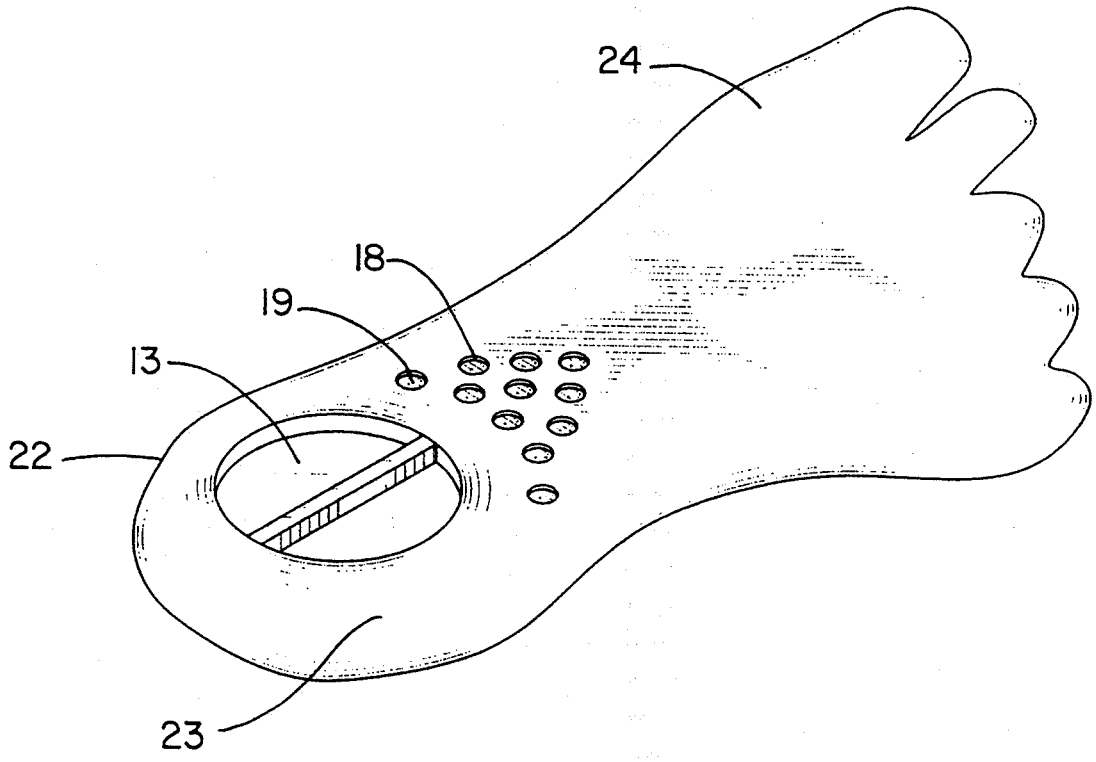
FIG. 5 is a top perspective view of a modification of the device of FIGS. 1–4.

While the boot shape 10 illustrated in the preceding drawings is the preferred version, the shape may be altered as shown in FIG. 5 to that of a human foot 22 having the scent dispensing canister 13 embedded in the heel portion 23 thereof with similar screened perforations 18 for dispensing the scented vapors therefrom placed in the upper portion 24 of foot 22. The essential feature is the elongated dimension of the boot 22 which, like the foot portion 16 of boot 10 provides a good beating action on the fiber-filled constructions placed in the drum dryer along therewith. Likewise the mass or weight of the device 22 must be substantial to achieve the desired affect.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A fiber declumping device for use in a rotary drum dryer containing a fiber-filled construction to be treated which comprises: an L-shaped beating member formed of a heat-resistant polymeric material; free to move within said drum; and means within said beating member to dispense aromatic vapors when rotating in said drum dryer; said L-shaped beating member resembles a boot having an ankle portion and a foot portion; said means to dispense aromatic vapors comprises a perforated canister positioned fixedly within said ankle portion of said beating member and spaced from the foot portion, the canister communicating through perforations in said beating member with the interior of the drum within which said member is freely positioned in use; the beating member having a receptacle concentrically mounted therewithin; said receptacle having an entrance opening extending through an exterior surface of the beating member in communication with the receptacle; a lid removably mounted to the entrance opening.

2. A device as in claim 1 wherein heat activated capsules are contained within said canister.

3. A device as in claim 1 wherein said perforated canister has fine mesh screen over the perforations thereof to prevent escape of particulate material from said capsules therethrough.

* * * * *